US009692137B2

(12) United States Patent
Sabielny

(10) Patent No.: US 9,692,137 B2
(45) Date of Patent: Jun. 27, 2017

(54) ANNULAR SLOT ANTENNA

(71) Applicant: EADS Deutschland GmbH, Ottobrunn (DE)

(72) Inventor: Michael Sabielny, Ulm (DE)

(73) Assignee: EADS Deutschland GmbH, Ottobrunn (DE)

( * ) Notice: Subject to any disclaimer, the term of this patent is extended or adjusted under 35 U.S.C. 154(b) by 424 days.

(21) Appl. No.: 13/865,346

(22) Filed: Apr. 18, 2013

(65) Prior Publication Data

US 2013/0278475 A1 Oct. 24, 2013

(30) Foreign Application Priority Data

Apr. 19, 2012 (EP) ..... 12002714

(51) Int. Cl.
*H01Q 13/10* (2006.01)
*H01Q 1/28* (2006.01)
*H01Q 13/18* (2006.01)

(52) U.S. Cl.
CPC ..... *H01Q 13/10* (2013.01); *H01Q 1/286* (2013.01); *H01Q 13/18* (2013.01)

(58) Field of Classification Search
CPC ..... H01Q 13/10; H01Q 13/18; H01Q 1/286
USPC ..... 343/769, 700 MS, 767, 789, 895, 898
See application file for complete search history.

(56) References Cited

U.S. PATENT DOCUMENTS 2,644,090 A * 6/1953 Dorne ..... H01Q 13/18 333/34
2,746,040 A * 5/1956 Martin ..... H01Q 9/40 343/769
2,834,959 A * 5/1958 Dorne ..... H01Q 1/286 343/769
3,718,869 A * 2/1973 Gerlach ..... H03B 9/145 331/101
4,443,802 A * 4/1984 Mayes ..... H01Q 13/18 343/729
4,682,180 A * 7/1987 Gans ..... H01Q 13/18 343/769
4,821,040 A * 4/1989 Johnson ..... H01Q 1/3275 343/700 MS
4,994,817 A * 2/1991 Munson ..... H01Q 13/18 343/746
5,194,876 A * 3/1993 Schnetzer ..... H01Q 13/18 343/746

(Continued)

FOREIGN PATENT DOCUMENTS

EP 0 439 677 A2 8/1991
FR 1.113.796 4/1956
GB 2005922 A * 4/1979 ..... H01Q 13/18

OTHER PUBLICATIONS

European Search Report with partial English translation thereof Dated Jul. 20, 2012 (Two (2) Pages).

(Continued)

*Primary Examiner* — Graham Smith
*Assistant Examiner* — Jae Kim
(74) *Attorney, Agent, or Firm* — Crowell & Moring LLP

(57) ABSTRACT

An annular slot antenna includes an inner conductor divided by a dielectric gap into a rear section and a front section. An inner conductor of a coaxial feed line is contacted with the front section of the inner conductor and the outer conductor of the coaxial feed line is contacted with the rear section.

10 Claims, 6 Drawing Sheets

(56) References Cited

U.S. PATENT DOCUMENTS

| | | | | |
|---|---|---|---|---|
| 5,202,697 | A * | 4/1993 | Bonebright | H01Q 13/18 343/708 |
| 6,288,685 | B1 * | 9/2001 | Thomas | H01Q 13/10 343/769 |
| 2004/0150575 | A1 * | 8/2004 | Lizalek | H01Q 1/286 343/767 |

OTHER PUBLICATIONS

Volakis, J.L. "A Scheme to Lower the Resonant Frequency of the Microstrip Patch Antenna" IEEE Microwave and Guided Wave Letters, vol. 2, No. 7, pp. 292 & 293, Jul. 1992, New York, US, XP000279147A.

Yuan, T.J. et al. "A Compact Broadband Omnidirectional Vertically Polarized VHF Antenna for Aircraft" pp. 1480-1483, $40^{th}$ European Microwave Conference, Sep. 2010, Paris, France.

Cumming, W.A. et al. "Design Data for Small Annular Slot Antennas" IRE Transactions on Antennas and Propagation, pp. 210 & 211, Apr. 1957.

Clavijo, S.A. et al. "Low-Profile Mounting-Tolerant Folded-out Annular Slot Antenna for VHF Applications" Antennas and Propagation Society International Symposium, pp. 13-16, 2007 IEEE, 2007.

* cited by examiner

ANNULAR SLOT ANTENNA

CROSS REFERENCE TO RELATED APPLICATIONS

The present application claims priority under 35 U.S.C. §119 to European Patent Application No. EP 12 002 714.9, filed Apr. 19, 2012, the entire disclosure of which is herein expressly incorporated by reference.

BACKGROUND AND SUMMARY OF THE INVENTION

Exemplary embodiments of the present invention relate to an annular slot antenna. The prior art in the case of annular slot antennas is well-documented in an array of technical publications, which illuminate various aspects of typical annular slot antennas. Reference is made here as examples to W. Cumming and M. Cormier, "Design data for small annular slot antennas", Antennas and Propagation, IRE Transactions on, volume 6, issue 2, pages 201-211, 1958, S. A. Clavijo, R. E. Diaz, and E. Caswell, "Low-profile mounting-tolerant folded-out annular slot antenna for VHF applications", in Antennas and Propagation Society International Symposium, 2007 IEEE, 2007, pages 13-16, and T. J. Yuan, et al. "A compact broadband omnidirectional vertically polarized VHF antenna for aircraft", in *Microwave Conference* (*EuMC*), 2010 European, 2010, pages 1480-1483. A classical annular slot antenna (see, for example, the Cumming et al. article), can accordingly be described by the illustration in FIG. 1. The metallic antenna body 1 forms a closed cavity, which is filled with air or a dielectric material 50, and comprises as the main components the rod-shaped inner conductor I between front plate V and rear plate H and also the jacket-like outer conductor A in the form of a jacket-shaped outer wall. The radiant circumferential annular slot 10 is located on the front plate V of the antenna 1. Reference numeral 99 identifies boreholes for inserting through fasteners, in order to attach the antenna to a carrier structure. The entire arrangement is typically constructed to be substantially rotationally-symmetrical (axis of symmetry 91). However, this does not apply for the feed of the antenna signal, which occurs laterally through a coaxial cable 20. The outer conductor of the coaxial cable 20 is contacted with the outer conductor A of the antenna. The inner conductor 21 of the coaxial cable 20 is led through the outer wall A of the antenna to the inner conductor I of the antenna.

The annular slot antenna 1 according to FIG. 1 can be understood as a ladder network of a plurality of coaxial line parts 2, 3, 4, 5 respectively having different radii for inner conductor and outer wall and have separate dielectric filling, as schematically shown in FIG. 2. The following components are thus obtained in the case of this observation:

2: coaxial line having short-circuit

3: coaxial line having T branch

4: coaxial line

5: coaxial aperture for radiation into the free space.

The general function principle of an annular slot antenna is based on two requirements:

1. mutual compensation of the susceptance of the short-circuited coaxial line 2 with the susceptance of the radiant annular slot 10, 2. impedance transformation from the impedance level of the feed line 20 (typically 50 ohm) to the level of the radiation resistance of the annular slot 10. The radiation resistance is typically very low-impedance, for example, in the order of magnitude of 1 ohm to 5 ohm.

If both above conditions are met, the antenna is in resonance. Without further measures (such as, for example, external adaptation circuits), the usable bandwidth is not particularly large in this case, since the antenna only has a single resonance mechanism (single-tuned antenna). The bandwidth achievable using the antenna is dependent on the ratio of the volume enclosed by the antenna to the respective wavelength in the case of resonance: the lower the volume, the lower the achievable bandwidth as well.

The known annular slot antennas, which are fed from the side, according to FIG. 1 must lead the inner conductor of the feeding coaxial cable in a suitable manner and secure it against mechanical stress. Furthermore, a lateral feed is generally not axially-symmetrical to the resonance body of the antenna, so that substantial asymmetries in the radiation diagram are to be expected.

U.S. Patent Publication U.S. 2004/0150575 A1 describes an annular slot antenna in which the feed occurs centrally via the rear plate. To increase the flexibility in the design of the antenna, a disc-shaped adaptation element, which is conductive or is conductively coated on its surface, is provided on the inner conductor, which adaptation element covers approximately the entire circumference of the antenna cavity and forms an annular dielectric intermediate space with the outer wall of the antenna.

French Patent Publication FR 1,113,796 A describes a further annular slot antenna having a central feed on its rear plate. Various sections of the inner conductor form individual windows, without interrupting the electrically conductive connection between these sections.

Exemplary embodiments of the present invention are directed to providing an alternative antenna design, which allows high flexibility in the design of the antenna.

A substantially axially-symmetrical construction can be achieved by the positioning of the feed point centrally on the rear plate of the antenna. Any asymmetries in the radiation diagrams of such annular slot antennas, which arise due to feed from the side, are thus dispensed with. The required length of the feed line—compared to the known antennas having lateral feed—also becomes significantly shorter by way of this arrangement.

In addition, due to the special design of the internal components, in particular the inner conductor, an impedance transformation from the reference impedance of the input line (for example, 50 ohm) to the radiation resistance of the annular slot can also be achieved in the case of situations in which the entire antenna becomes electrically small (for example, a diameter less than one eighth of the respective wavelength).

The inner conductor is divided according to the invention by a dielectric gap into a front section and a rear section, wherein the inner conductor of the coaxial feed line is contacted with the front section of the inner conductor and the outer conductor of the coaxial feed line is contacted with the rear section.

The dielectric gap forms an additional design parameter of the antenna, which may advantageously be used in a suitable manner in the design of the antenna. In particular, the series capacitance formed by this gap can be used as a compensation parameter for other components having reactances or susceptances.

The folded annular slot antenna according to the invention is suitable as a replacement for any form of monopole antenna because it is electrodynamically complementary thereto. Monopole antennas and annular slot antennas (in the present construction) have nearly identical radiation diagrams (complete coverage in the azimuth and a zero point at elevation of 90°), but annular slot antennas may be embedded better in structures in the case of which a conformal and surface-conforming installation must be ensured. This property provides lower air resistance and a smaller radar signature in the case of aircraft, for example.

BRIEF DESCRIPTION OF THE DRAWING FIGURES

The invention will be explained in greater detail on the basis of concrete exemplary embodiments with reference to figures. In the figures.

DETAILED DESCRIPTION

Figure 1:
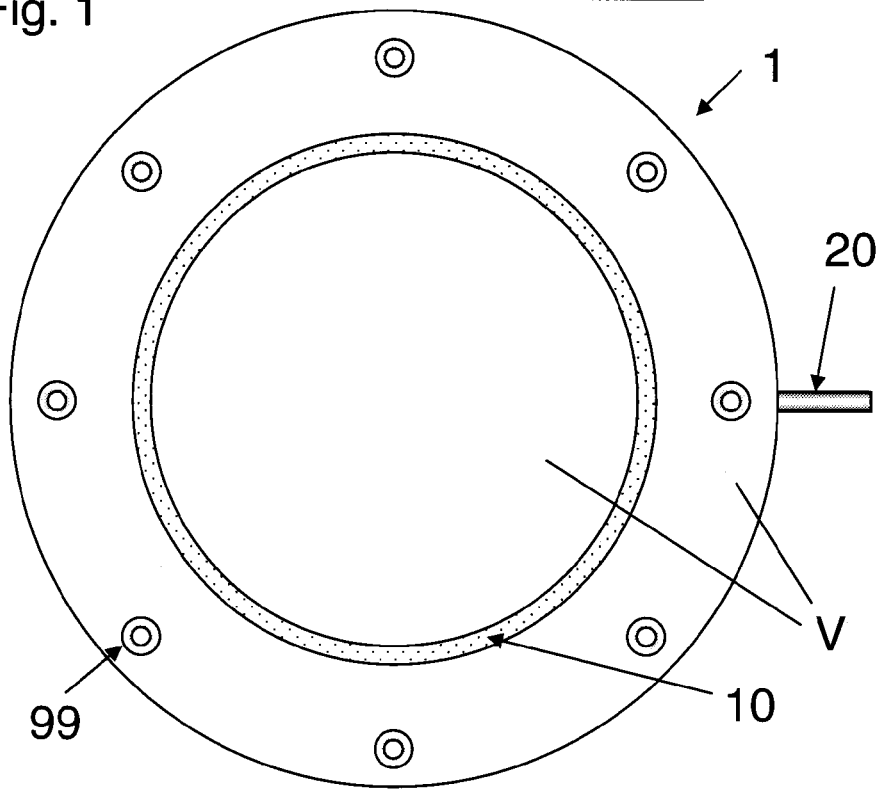
Fig. 1 Prior art
FIG. 1 shows the construction of a typical annular slot antenna in horizontal projection and in a sectional illustration, perpendicular thereto, as explained in the introduction to the description.
Figure 1:
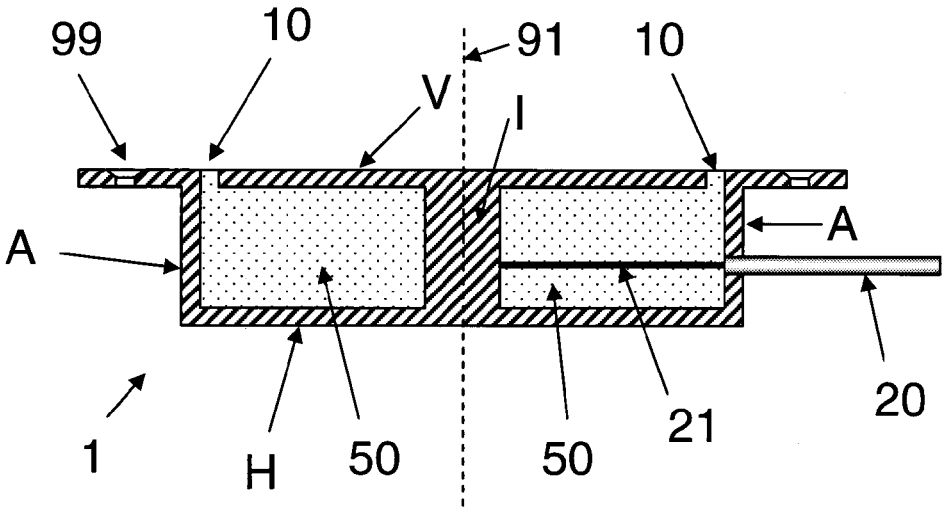
Fig. 1 Prior art
Figure 2:
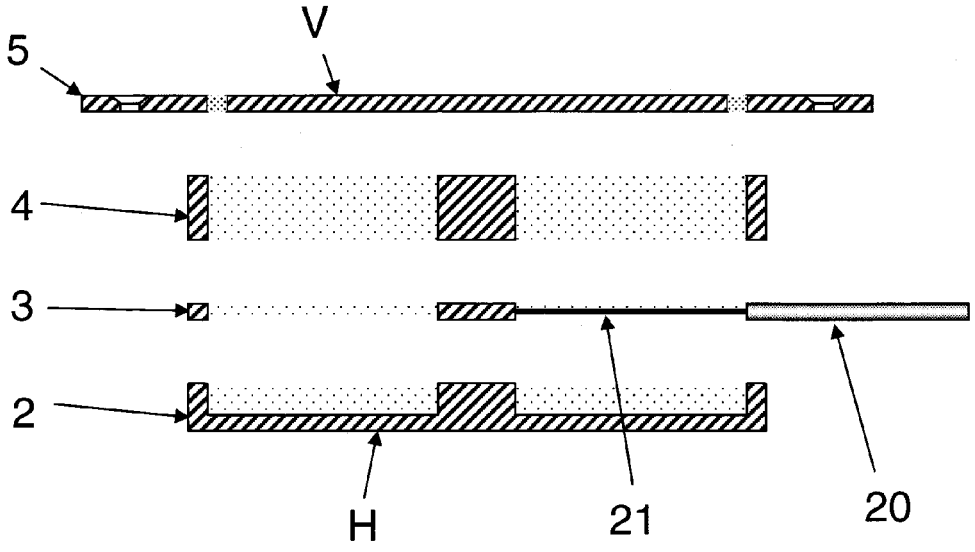
Fig. 2 Prior art
FIG. 2 shows the components of a typical annular slot antenna as a ladder network of a plurality of conductors as an equivalent circuit diagram, as explained in the introduction to the description.
Figure 3:
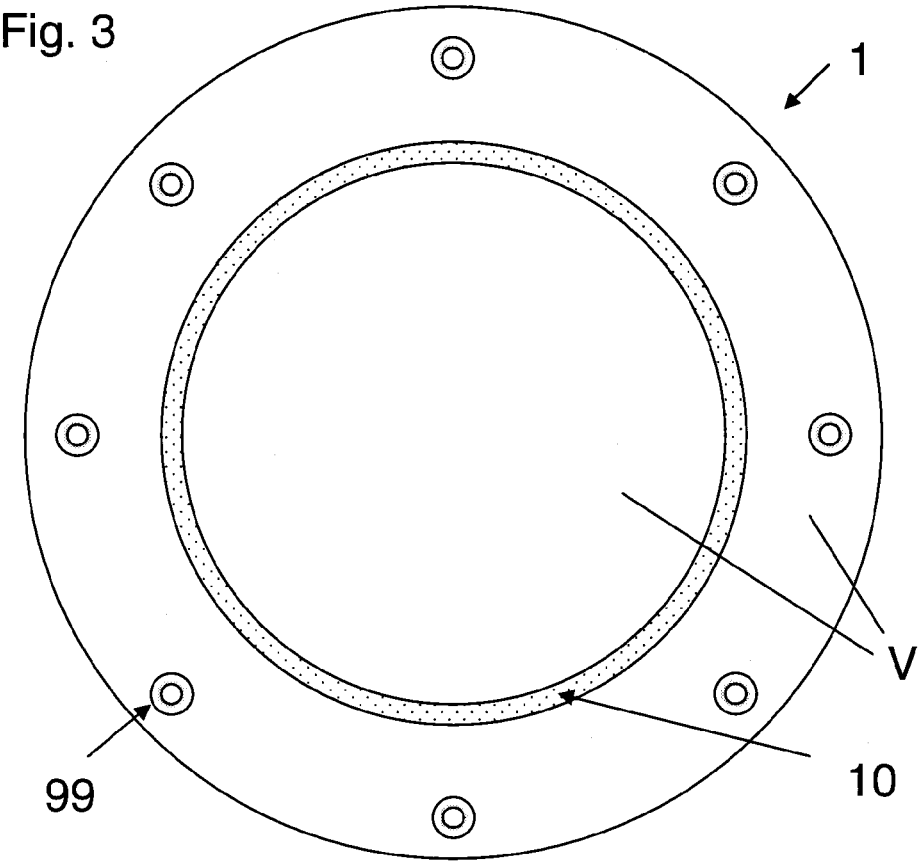
FIG. 3 shows the construction of an antenna according to the invention in horizontal projection and in a sectional illustration, perpendicular thereto.
Figure 3:
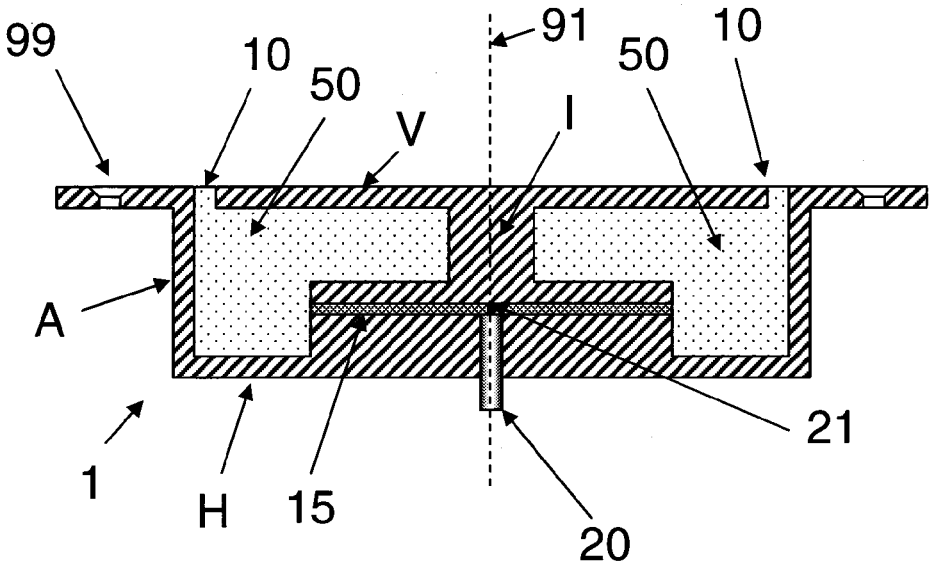

FIG. 3 shows an antenna 1 according to the invention (identical reference signs identify identical drawing elements, this is true throughout all of FIGS. 1 to 6). The exemplary arrangement shown is rotationally-symmetrical having the central axis 91 as the axis of symmetry. Front plate V, rear plate H, and the jacket-like outer wall A each have constant diameter and together form a cavity, as in the case of the known antennas, which cavity is filled with air or with a dielectric material. The dielectric material can be selected such that it generates the least possible dielectric losses.

The contacting of the feed line, formed as the coaxial line 20 having inner conductor 21, occurs through the rear plate H centrally on the axis of symmetry 91 of the antenna 1. Asymmetries in different radial directions in the radiation diagram are precluded using this construction. The inner conductor I is divided by a dielectric gap 15 into a front section (the section above the gap 15 in FIG. 3) and a rear section (the section below the gap 15 in FIG. 3). This gap can be filled either with air or with a solid dielectric material. The coaxial feed line 20 is connected to the antenna such that: (1) the inner conductor 21 of the feed line 20 is contacted with the front (upper) section of the inner conductor I; and (2) the outer wall of the feed line 20 is contacted with the rear (lower) part of the inner conductor I.

As can also be seen from FIG. 3, the inner conductor I has a stepped construction, such that its diameter increases from the front plate V towards the rear plate H of the antenna. The stepped transition of the diameter thus formed is located inside the front section of the inner conductor I. The dielectric gap is located in the region of the inner conductor I which has an increased diameter.

This step is advantageous for the impedance transformation from the impedance level of the feed line 20 (typically 50 ohm) to the level of the radiation resistance of the annular slot 10. The enlargement of the inner conductor cross section can alternatively also occur continuously.

Figure 5:
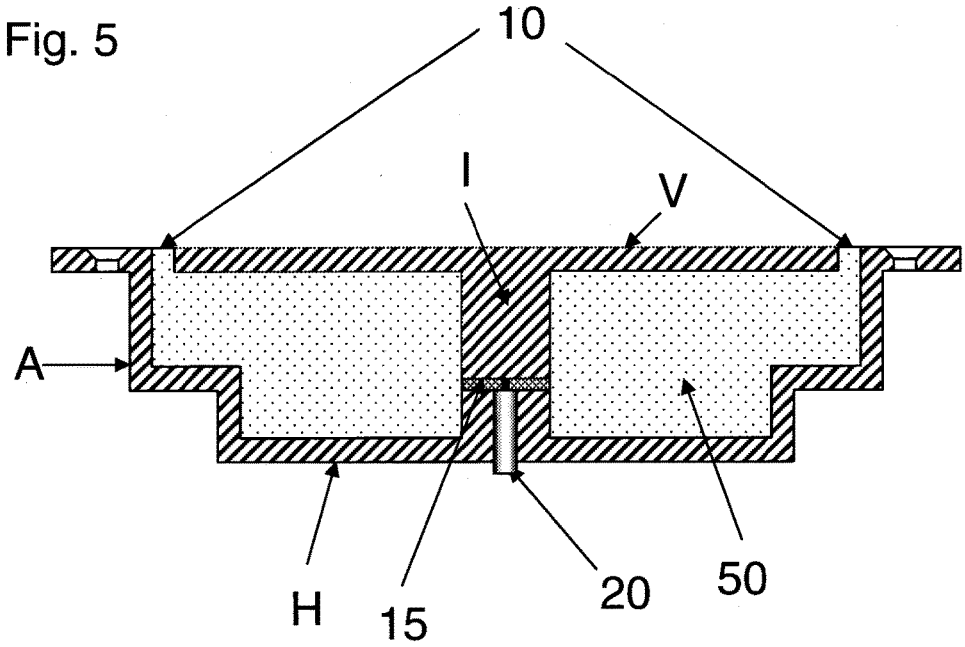
FIG. 5 is a sectional illustration of the construction of a further embodiment according to the invention of an antenna having a radome.

For the case that, for example, for mechanical reasons an increase in the diameter of the inner conductor I is not possible, the goal of optimum impedance adaptation can also be achieved using a change of the diameter of the outer wall A (FIG. 5). The enlargement of the outer wall cross section can occur suddenly in the form of a step, as shown in FIG. 5, so that two regions of the outer wall having greater or lesser diameter, respectively, are formed. The region of the outer wall having increased diameter is located close to the front plate V of the antenna, while the region of the outer wall having comparatively small diameter is located close to the rear plate H. The dielectric gap is located in the volume enclosed by the outer wall region having smaller diameter. As an alternative to a sudden transition, an increase of the diameter can also occur continuously.

The dielectric gap and the described shape of the inner conductor I and/or the outer wall A form additional parameters of the antenna, which may advantageously be used in a suitable manner in the design of the antenna. In particular, an impedance transformation from the reference impedance of the input line (for example, 50 ohm) to the radiation resistance of the annular slot can therefore be achieved more easily and flexibly also in the case of situations in which the entire antenna becomes electrically small (for example, diameter less than one eighth of the respective wavelength).

The fact that the contacting of the feed line occurs in the interior of the volume enclosed by the antenna 1 reflects the character of the antenna according to the invention, which is folded into itself. This measure ensures better mechanical protection for the contact point of the feed line.

Figure 4:
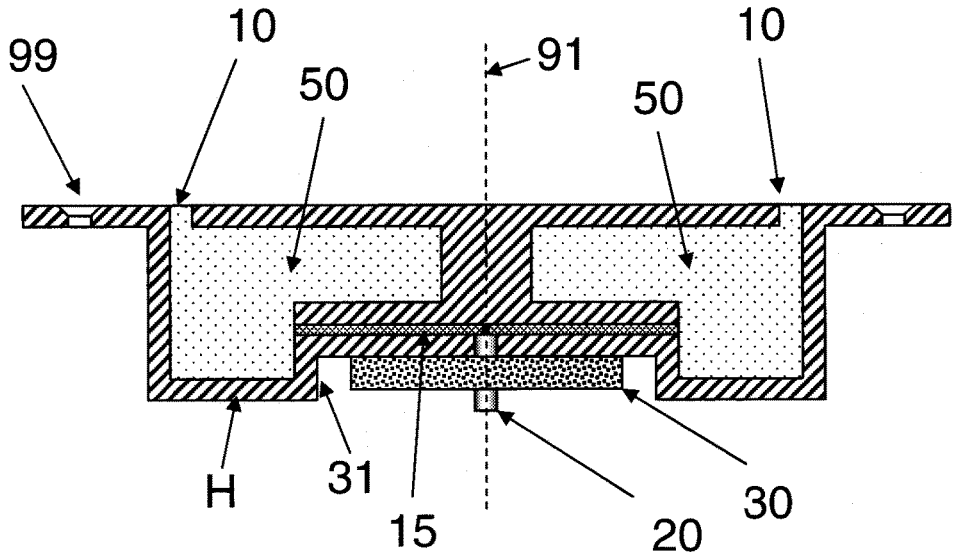
FIG. 4 is a sectional illustration of the construction of a further embodiment according to the invention of an antenna having an integrated adaptation circuit.

In order to improve the bandwidth of the antenna according to the invention (at the cost of the level of the impedance adaptation), an optional adaptation network 30 can be used, as shown in FIG. 4. This adaptation network 30 is also integrated into the enclosed volume of the antenna by the formation of the antenna body 1 shown in FIG. 4. For this purpose, the rear plate H of the antenna has an indentation 31, in which the adaptation circuit 30 is arranged in a countersunk manner. The adaptation circuit is advantageously placed centrally around the axis of rotation, so that the symmetry of the overall arrangement is not disturbed. Mechanical projection of the adaptation network is also achieved by this design.

Figure 6:
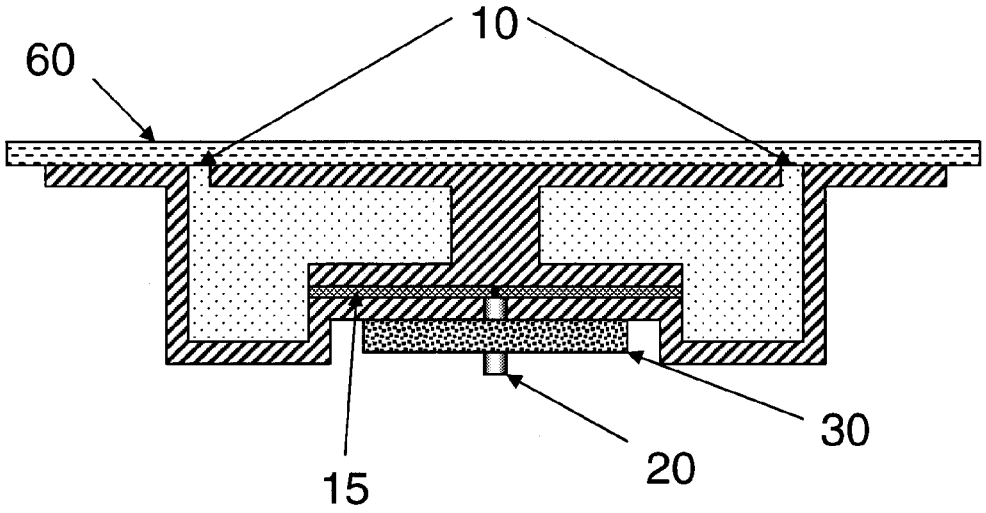
FIG. 6 is a sectional illustration of the construction of a further embodiment according to the invention of an antenna having a radome.

In an advantageous embodiment, the antenna according to the invention can be covered using a radome. This radome is used for the mechanical protection of the antenna or the adaptation of the antenna structure to the surface of an installation platform, for example, a vehicle, in particular an aircraft. FIG. 6 shows a corresponding embodiment of the antenna, in which the front side V of the antenna is covered using a radome 60. This is a dielectric layer which is designed to be as neutral as possible with respect to the radiation of the antenna. In a particular embodiment, it can be a frequency-selective radome.

Figure 7:
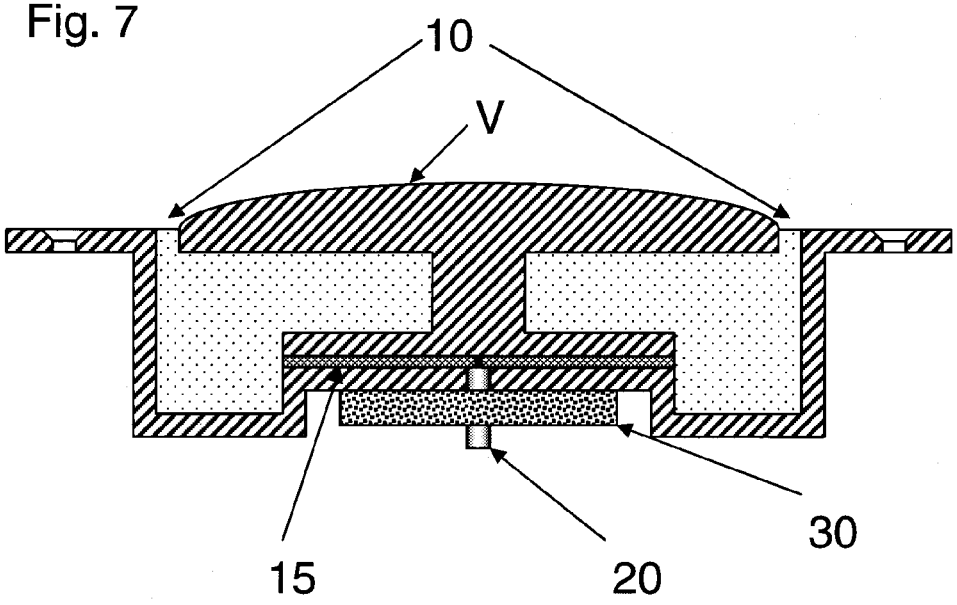
FIG. 7 is a sectional illustration of the construction of a further embodiment according to the invention of an antenna having a curved front plate.

The front plate V of the antenna does not necessarily have to be formed planar. In particular for adaptation and conformity with the surface structure of an installation platform which surrounds it, it can also be designed as curved, in particular curved in one axis or two axes. FIG. 7 shows such an embodiment. It may be seen that the surface of the front plate V of the antenna is embodied to be curved. The curvature can be selected such that the symmetry of the overall arrangement is not disturbed. However, it is also possible as provided by the surface structure of the installation platform to deviate from a rotationally-symmetrical construction with respect to the shape of the front plate of the antenna. This is the case, for example, in the event of a single-axis curved embodiment of the front plate of the antenna.

Figure 8:
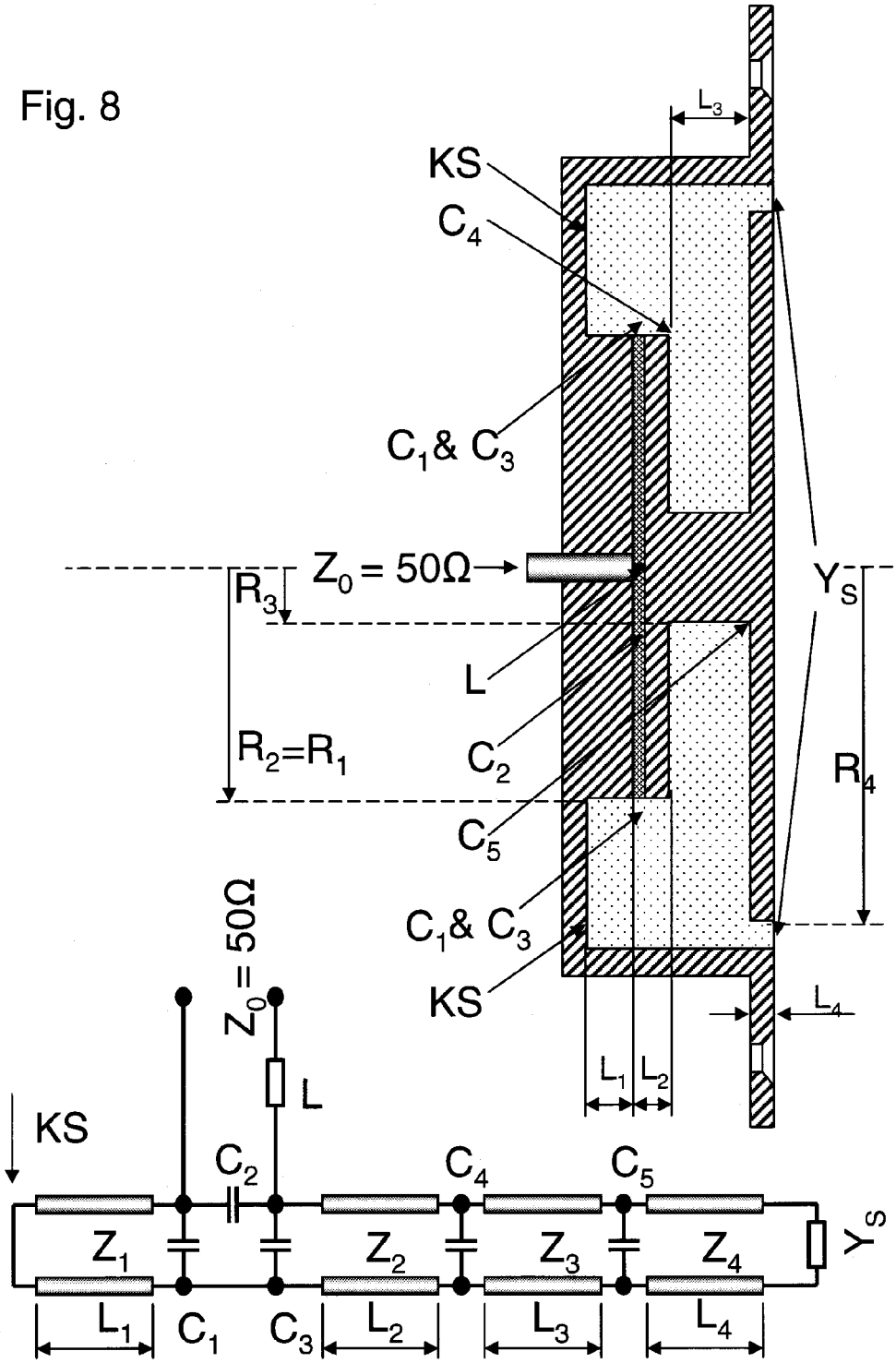
FIG. 8 shows the equivalent circuit diagram of an antenna according to the invention as shown in FIG. 3.

All of the electrodynamic properties of the antenna according to the invention may be transferred into an equivalent circuit diagram in the meaning of a line model, as shown in FIG. 8. The entire antenna is conceived as a collection of parts of (degenerate) coaxial cables, similarly to the division performed in FIG. 2, and the complete axial-symmetrical structure of the antenna is utilized.

The feed of the antenna using a coaxial cable is performed according to the invention such that the inner conductor and the outer conductor of the antenna are contacted with the antenna body on different sides of the dielectric gap. The capacitance of this gap is shown by the capacitor $C_2$ connected in series (within the overall circuit described in greater detail hereafter). This is calculated substantially according to the known formulae for plate capacitors in electrostatics. The parallel capacitances $C_1$ and $C_3$ are the circumferential stray capacitances around the dielectric gap. The intrinsic inductance of the exposed inner conductor of the feed cable is modeled by the series inductance L.

From the viewpoint of the feed cable, two lines originate from its contact point. A first line $Z_1$ having the length $L_1$ leads to a short-circuit KS, which is the antenna rear wall in the real antenna. The other line is a ladder network of individual line parts $Z_2$, $Z_3$, $Z_4$, which differ in the characteristic impedance because of the different radii $R_2$, $R_3$, $R_4$ of the respective inner conductor section and additionally respectively have different lengths $L_i$.

The dielectric gap directly adjoins the second line $Z_2$ having the length $L_2$. Because the radii $R_1$ and $R_2$ are identical, the characteristic impedance of the two associated coaxial line parts $Z_1$, $Z_2$ of the length $L_1$ or $L_2$, respectively, is identical. At the right end of line $Z_2$ having the length $L_2$, there is a strong jump in radius to a smaller value. This jump is represented by the parallel capacitance $C_4$. This is adjoined by the third line $Z_3$ having the length $L_3$, which has a significantly smaller inner conductor radius $R_3$. At the right end of line $Z_3$ having the length $L_3$ there is again a strong jump in the inner conductor radius, which is described with the parallel capacitance $C_5$, similarly to $C_4$. The piece of the fourth line $Z_4$ of the length $L_4$ generally only has a very short length, dimensioned by the thickness of the metal cover of the antenna, in which the annular slot is located. At the end of this fourth line $Z_4$ of the length $L_4$, this ring slot is located as the radiant aperture, which can be modelled by a matching admittance $Y_s$.

All mentioned radii, lengths, and other geometric properties of the real antenna can be converted with good precision by mathematical operations directly into the matching values for the equivalent circuit diagram. With the aid of a line similar, the reflection factor at the input of the antenna can then be calculated in a very short time. A particularly rapid and efficient method for designing such antennas is therefore provided, independently of the question of the resonance frequency, the bandwidth, or the structural size. In consideration of the generally recognized relationships between geometric antenna size, resonance frequency, bandwith, and quality factor, annular slot antennas can therefore be calculated in manifold formations and matching with the respective requirements.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An annular slot antenna for use with a coaxial feed line having an inner feed line conductor and an outer feed line conductor, wherein the annular slot antenna is axially symmetric with respect to a center line of the inner feed line conductor, the antenna comprising:

an inner conductor;

a outer wall, which surrounds the inner conductor;

a front plate having a circumferential annular slot; and a rear plate, which is opposite to the front plate, wherein front plate and rear plate are connected by the inner conductor, and wherein a cavity is formed by the front plate, rear plate, and the outer wall, wherein a dielectric gap is disposed in a portion of the inner conductor and extends across an entire diameter of said portion such that the inner conductor is divided by the dielectric gap into a rear section disposed towards the rear plate and a front section disposed towards the front plate, wherein the rear plate and the inner conductor enable the coaxial feed line to contact the annular slot antenna centrally via the rear plate such that the inner feed line conductor contacts the front section of the inner conductor, and the outer feed line conductor contacts the rear section, and wherein the inner conductor has a stepped construction such that a diameter of the inner conductor increases in a direction towards the rear plate in a stepped manner.

2. The annular slot antenna according to claim 1, wherein the contact of the coaxial feed line to the annular slot antenna is completely enclosed by the cavity.

3. The annular slot antenna according to claim 1, wherein a diameter of the outer wall is constant along said direction.

4. The annular slot antenna according to claim 1, wherein a diameter of the outer wall increases in a direction towards the front plate, wherein a diameter of the inner conductor is constant along said direction.

5. The annular slot antenna according to claim 4, wherein the increase of the diameter of the outer wall occurs in steps or continuously.

6. The annular slot antenna according to claim 3, wherein the dielectric gap is located in a section of the inner conductor having an increased diameter.

7. The annular slot antenna according to claim 4, wherein the increase of the diameter of the outer wall occurs in steps, and wherein the dielectric gap is located in a section of the volume enclosed by the outer wall having a smaller diameter.

8. The annular slot antenna according to claim 1, wherein the rear plate has an indentation, within which an adaptation network is housed, wherein the adaptation network is configured to increase a bandwidth of the antenna.

9. The annular slot antenna according to claim 1, wherein an outer surface of the front plate is planar or curved.

10. The annular slot antenna according to claim 1, wherein a surface of the front plate is covered by a radome.

* * * * *